United States Patent [19]

Richner

[11] 4,333,329

[45] Jun. 8, 1982

[54] CROSS TRANSPORT PRESS

[75] Inventor: Hans Richner, Büsserach, Switzerland

[73] Assignee: Hatebur Umformmaschinen AG, Reinach, Switzerland

[21] Appl. No.: 120,232

[22] Filed: Feb. 11, 1980

[30] Foreign Application Priority Data

Feb. 26, 1979 [DE] Fed. Rep. of Germany ..... 2907464

[51] Int. Cl.[3] ..... B21D 55/00; B21D 37/16

[52] U.S. Cl. ..... 72/3; 10/23; 72/12; 72/342

[58] Field of Search ..... 72/405, 26, 4, 10, 11, 72/12, 364, 342, 3; 10/23, 12 T

[56] References Cited

U.S. PATENT DOCUMENTS 3,444,390 5/1969 Breidenbach ..... 72/4

3,969,668 7/1976 Weinzinger ..... 72/10

*Primary Examiner*—Gene P. Crosby

*Attorney, Agent, or Firm*—Ladas & Parry

[57] ABSTRACT

Apparatus for periodically sensing and cooling the end face of one or more rams of an automatic cross transport press. In a cross transport press, on the press frame (1) there is mounted a sensing rocker (9) which executes a periodical rocking movement about a horizontal axis (A) in the work rhythm of a carriage (2) provided with rams (5). The movement of the sensing rocker (9) is transmitted from the carriage (2) through a connecting rod (20), a transmission lever (17) and the two rocker arms (8) to sensing elements (27) equipped with cooling sprinklers. The slightly angled transmission lever (17) rests upon a stop (15) and is retained upon the stop (15) by a spring (25). If a sensing element (27) encounters an obstacle, then the press is stopped; simultaneously the transmission lever (17) lifts from the stop counter to the return force of the spring (25), whereby any damage is prevented. The sensing rocker can be pivoted upwards into a rest position if a pneumatically loaded piston is used instead of the spring (25).

8 Claims, 6 Drawing Figures

CROSS TRANSPORT PRESS

The present invention relates to cross transport presses.

In the non cutting shaping of metal components on automatic cross transport presses, as is known, a length of a feed wire is cut off and brought into desired shape consecutively in a plurality of mutually juxtaposed shaping stations. Each shaping station possesses a die and a ram moving in reciprocation on a press carriage arranged coaxially to the die.

Immediately after shaping the pressing is gripped by a gripper at each station and transported to the adjacent station or ejected after the final station. It may then occur that the pressing has been retained on the ram after shaping, travels back with the ram and a "double loading" therefore occurs when the fresh pressing is fed. This can result in serious damage to the press tools due to the high driving and mass forces which are present.

In order to obviate damage caused to the press tools in such a manner, sensing apparatuses have been developed which slide along the front face of the ram after each shaping operation and stop the press as soon as they encounter an obstacle.

The known sensing mechanisms of this type are driven in the work rhythm of the press through cam discs. This type of drive is extraordinarily expensive and also does not permit the sensing mechanism to be made to pivot automatically into an upper rest position to allow for service interruptions (repairs, tool exchange etc.); the pivoting upward must on the contrary be performed by hand.

Another disadvantage of the known sensing and cooling apparatuses of this type lies in the complicated and fault-prone cooling medium supply, which hitherto had to be effected by means of flexible hoses in all cases.

According to the present invention, there is provided a cross transport press comprising: a press frame, a press carriage mounted in sliding bearings, which is arranged to be driven in reciprocation through a crank transmission and to a forward end of which is rigidly attached at least one ram for shaping metal components; and means for periodically sensing and coding the end face of the at least one ram, the means comprising a sensing rocker which is arranged to be driven in the work rhythm of the ram, carries at least one sensing element at a forward end thereof and is mounted about a pivot axis so that during normal operation of the press the sensing rocker travels in front of the forward end of the ram in the region of the rear dead-centre position of the press carriage and stops the press if it encounters an obstacle, the sensing rocker comprising at least one rocker arm arranged on the press frame beside the or each ram which is mounted for rotation about a horizontal axis and which is articulatedly engaged by one end of a transmission lever, the other end of which is driven from a crank transmission, a stop being provided on the rocker arm which determines the lower position of the transmission lever and the transmission lever is further retained on the stop of the rocker arm by an elastic element so that the transmission lever lifts from the said stop counter to the return force of the elastic element if the sensing element is unable to attain its lower limit position.

The invention will be further described by way of example with reference to the accompanying drawings, in which.

Figure 2:
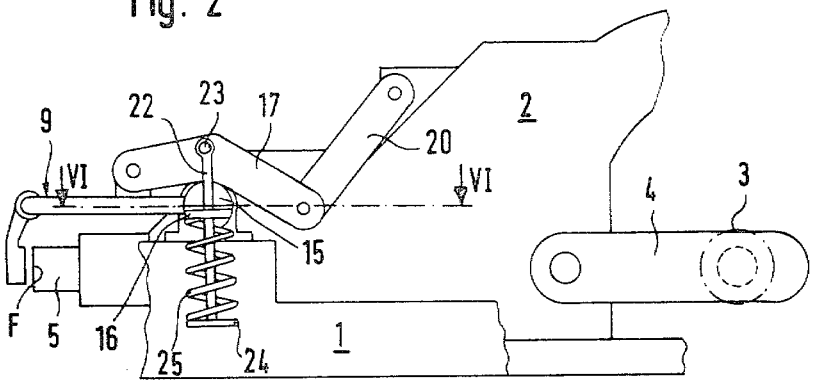
FIGS. 2 to 5 are simplified side elevations and show the apparatus in four different positions.
Figure 3:
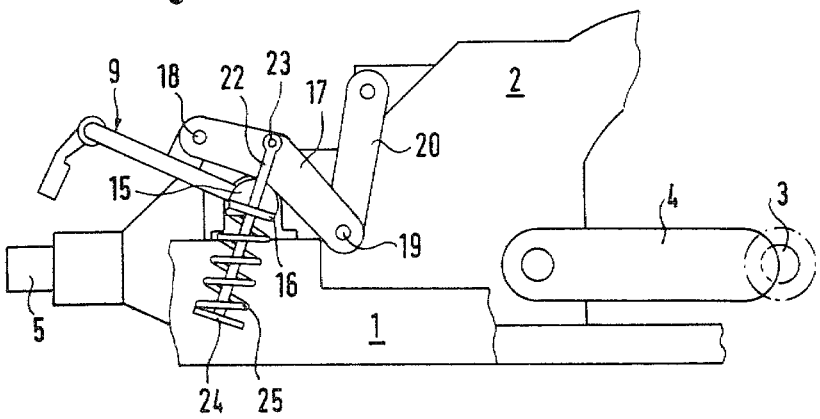

A press carriage 2 is mounted in sliding bearings in a press frame 1 and is driven in reciprocation from a crankshaft 3 (FIG. 2) through the intermediary of a connection rod 4. The press carriage supports three rigidly attached rams 5 on its end face. During the operation of the press, the rams 5 are moved periodically with the press carriage in the direction of the double arrow 6 and thus co-operate in known manner with dies, not shown, arranged coaxially with themselves.

On each of the two sides of the press carriage 2, a bearing block 7 is attached to the press frame 1 (cf. also FIG. 6), to each of which a rocker arm 8 of a sensing rocker generally designated 9 is mounted for rotation. Each rocker arm 8 possesses two tubes 10 which are attached through two tubular spigots 11 (FIG. 6) to a sleeve 12 and are also retained by a distance sleeve 11*a*. The sleeve 12 closed by two discs 13 and 14 at its end faces and serving as a journal is mounted pivotably in a bore of the bearing block 7. A stop 15, to the external surface of which a spring plate 16 is attached, is mounted for rotation on the sleeve 12. The stop 15 participates with the spring plate 16 in the periodic angular movement of the sleeve 12 which is described in detail hereinbelow.

Against the upper domed support surface of the stop 15 there is braced a slightly angled transmission lever 17 which engages on the one hand (articulation 18) the rocker arm 8, and on the other hand (articulation 19) a connecting rod 20 which is in turn mounted for rotation on the carriage 2 (articulation 21) through the intermediary of an axle 21*a* and thus participates in the carriage movement.

The transmission lever 17 is engaged approximately in its central region by a traction rod 22 (articulation 23), which carries a second spring plate 24 at its lower end. The traction rod is passed in loosely sliding manner through the stop 15. It draws the transmission lever 17 against the stop 15 under the influence of a spring 25, the elastic pretension of the spring 25 being chosen so that it is impossible for the transmission lever 17 to rise from the stop during normal operation of the press—i.e., under the influence of the normally acting inertial forces.

Sensing elements 27, which have an approximately U-shaped cross-section in the embodiment illustrated, are slid onto a tube 26 by means of a sleeve 27*a* and are clamped in their operative position e.g., by a screw.

During the operation of the shaping press the reciprocating movement of the carriage 2 is transmitted through the connecting rod 20 and the transmission lever 17 to the sensing rocker 9, which thus rocks up and down in the work rhythm of the ram 5 so that the sensing elements 27 attached to the bracket tube 26 just slide past the ram front surfaces F (FIG. 2) about the rear dead-centre position each time and thus sense whether they are free or still occupied by a pressing. If no such obstacle is present (cf. FIG. 2) then the sensing elements 27 attain their lower limit position in which they operate a contactless proximity switch and thus ensure that the press is not switched off.

Figure 5:
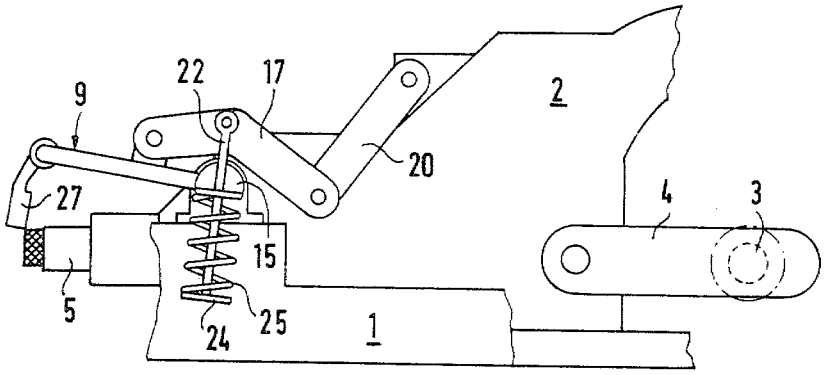

Now if one of the sensing elements 27 encounters such a pressing which has been retained on the ram or another obstacle present on the end face of the ram, then the downwardly oriented rocking movement of the sensing rocker 9 is abruptly interrupted; the forces acting upon the lever systems 8-17-20 due to this impact lifts the transmission lever 17 from the stop 15 counter to the return force of the spring 25, so that any damage is prevented. Simultaneously the press has been stopped by the reaction of a contactless proximity switch. The corresponding position of the apparatus is illustrated in FIG. 5.

Figure 1:
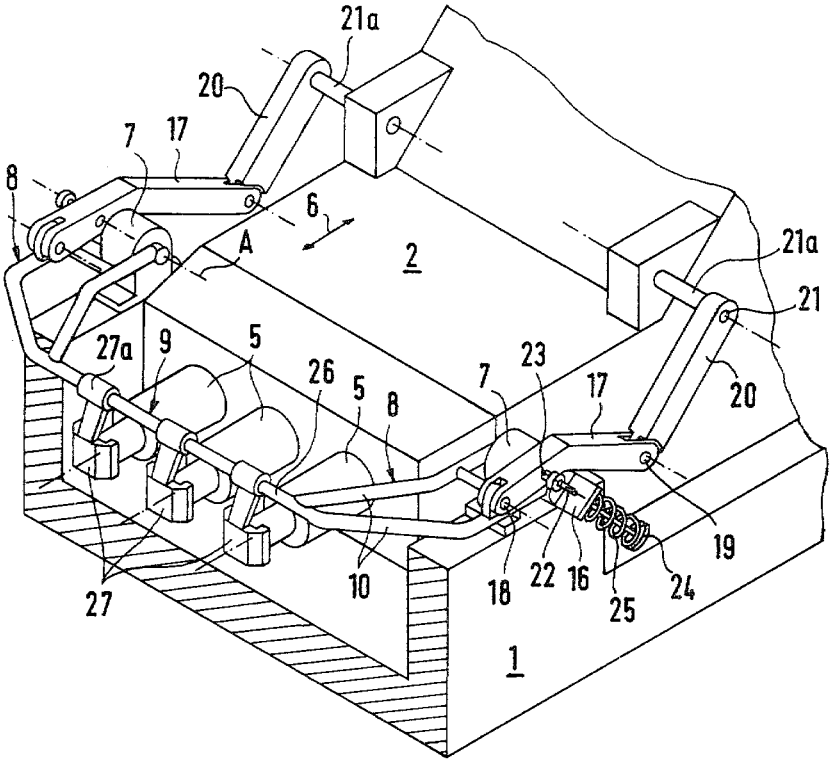
FIG. 1 is a simplified perspective view of the tool part on the ram side of an automatic cross transport press incorporating the present invention.
Figure 6:
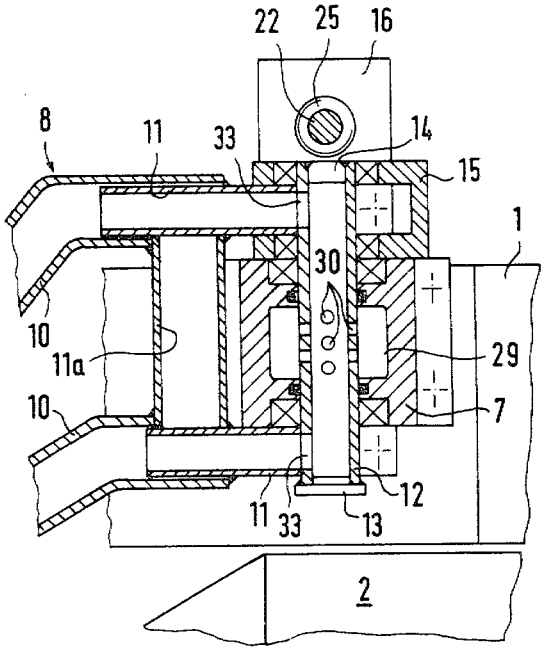
FIG. 6 is a section made along the line VI—VI in FIG. 2.

However, the apparatus described does not only exert a sensing control, but also a cooling effect upon the end faces of the sensed rams, which is required for as long a time as possible in the case of hot shaping. As FIG. 6 shows, the rocker arms 8 are constituted by tubes 10 which carry the cooling medium to the bracket tube 26 (FIG. 1), where it is sprinkled onto the rams through cooling sprinklers, i.e., rows of holes arranged on the interior surface of the sensing elements 27.

The supply of the liquid cooling medium occurs through an annular channel 29 arranged in the bearing block 7, from where it passes through radial bores 30 into the sleeve 12 and from there through lateral bores 33 into the rocker arms 8.

In a preferred embodiment the elastic pretension which acts through the traction rod 22 upon the transmission lever 17 is achieved not by a spring, but by a pneumatically loaded cylinder and piston unit. In this variant there is attached to the lower end of the traction rod 22 a piston 32 which is mounted in a double-acting cylinder and is subject to a downwardly acting pneumatic pretension. If the sensing element 27 is travelling into the control position encounters an obstacle, then the pneumatic cushion exerts the same function as the spring 25.

Figure 4:
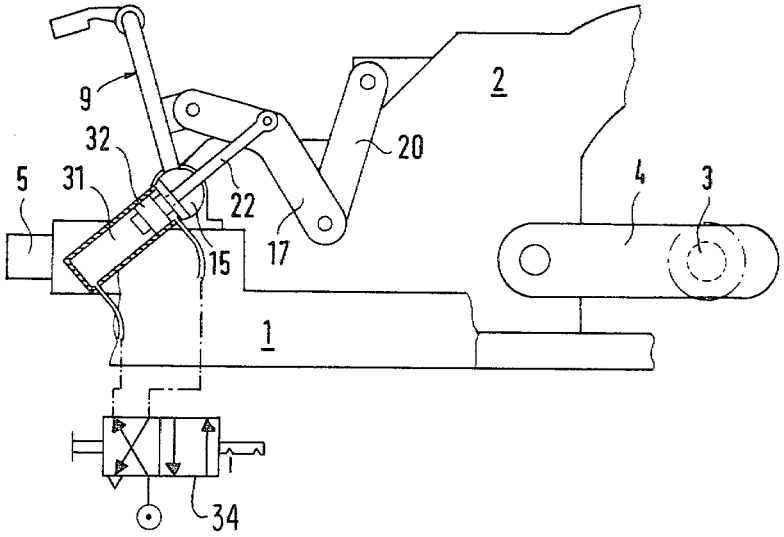

However, beyond this elastic damage pretension means, the piston and cylinder unit makes it possible to pivot the sensing rocker 9 into an upper rest position illustrated in FIG. 4 by pressing a button. For this purpose the stroke of the piston is chosen so that the rod 22 lifts the transmission lever 17 from the stop and pushes it upwards when an appropriate pneumatic pressure is applied. This position is particularly important for tool changes and adjustment work. The geometrical ratios of connecting rod 20, transmission lever 17 and rocker arm 8 are mutually coordinated in this variant in such a way that the machine can be turned over even with the sensing rocker pivoted upwards. The appropriate coordination of the lever length and articulation points is naturally a function of the order of magnitude of the individual components and lies within the competence of the expert, so that the description of a numerical example is omitted.

In FIG. 4 which shows the sensing rocker 9 in its upward pivoted position, such a double-acting pneumatically loaded cylinder is designated 31. The rod 22 is attached at its lower end to a position 32 which occupies its top dead-centre position in the upwardly pivoted position of the sensing rocker. The double-acting cylinder 31 is provided in known manner with compressed-air connections and vent orifices, which permit any desired operation of the piston in both directions.

By virtue of this possibility to pivot the sensing rocker upwards in case of need, the tool space is optimally accessible. This upward pivoting can be performed in any desired press carriage position.

Simultaneously with the upward pivoting of the rocker, a valve is actuated which inhibits the supply of the cooling medium.

In comparison with the known systems serving the same purpose, the apparatus described presents the following principal advantages:

The oscillating movement of the sensing rocker occurs slowly in the region of the control position—i.e., the cooling period is long.

The cooling sprinkler arranged on the internal surface of each sensing element 27 approaches the ram from the front top and departs again to the front top, it therefore follows the ram movement.

It is immediately possible to arrange for the sensing rocker 9, when it encounters an obstacle, to be pivoted automatically upwards into its rest position by the pneumatically loaded piston 32.

All the bearings and seals are located outside the heat and dirt zones.

The simple possibilities for fixing the sensing elements 27 and the cooling sprinklers attached to them, and the possibility of pivoting the sensing rocker upwards, contribute to short changeover times.

The embodiment described can be varied in many ways. In the case of a single-stage press i.e., provided with a single ram 5 it may e.g., be sufficient to mount the sensing rocker 9 unilaterally with only one arm 8. In the case of multiple-stage presses however, probably only the two-armed embodiment such as that described will be successful.

What I claim is:

1. A cross transport press comprising: a press frame; a press carriage mounted in sliding bearings, which is arranged to be driven in reciprocation through a crank transmission and to a forward end of which is rigidly attached at least one ram for shaping metal components; and means for periodically sensing and cooling the end face of the at least one ram, the means comprising a sensing rocker which is arranged to be driven in the work rhythm of the ram, carries at least one sensing element at a forward end thereof and is mounted about a horizontal pivot axis so that during normal operation of the press the sensing rocker travels past in front of the forward end of the ram in the region of the rear dead-centre position of the press carriage and stops the press if it encounters an obstacle, the sensing rocker comprising at least one rocker arm arranged on the press frame beside the ram, which is mounted for rotation about said pivot axis and which is articulatedly engaged by one end of a transmission lever, the other end of which is operatively driven from a crank transmission, a stop being provided on the rocker arm which determines the lower position of the transmission lever and the transmission lever is further retained on the stop of the rocker arm by an elastic element so that the transmission lever lifts from the said stop counter to the return force of the elastic element if the sensing element is unable to attain its lower limit position.

2. A press according to claim 1, wherein the sensing rocker comprises two rocker arms mounted rotatably on the press frame on both sides of the ram, which are connected together by a tube which is provided with sensing elements and cooling sprinklers and serves for the supply of the cooling liquid.

3. A press according to claim 1 or 2, wherein the transmission lever exhibits a curved or angled shape and rests upon the stop.

4. A press according to claim 1 or 2, wherein the elastic element is a helical spring which tends to urge the transmission lever against the stop and is adjusted so that it does not permit a lifting of the transmission lever from the stop under the influence of inertial forces.

5. A press according to claim 1 or 2, wherein the elastic element is a pneumatically loaded cylinder mounted pivotably in the press frame, the pivot axis of which coincides with that of the associated rocker arm and which is subject to such a pneumatic pretension that the latter does not permit a lifting of the transmission lever from the stop under the influence of inertial forces.

6. A press according to claim 5, wherein the pneumatically operated cylinder is provided with a control valve and the piston stroke is dimensioned so that the rocker arm can be pivoted into an upper rest position.

7. A press according to claim 6, wherein the transmission lever is connected to the press carriage via a connecting rod and the rocker arm, transmission lever and connecting rod are mutually co-ordinated so that on the one hand the desired periodic movement of the sensing rocker in passing the front end of the ram is obtained and on the other hand the rocker arm pivoted up into its rest position is moved to a minimum degree relative to the press frame.

8. A press according to claim 1, wherein the sensing rocker is in the form of a tubular structure and constitutes a supply pipe for cooling medium.

* * * * *